United States Patent [19]

Mutschler

[11] 3,941,491

[45] Mar. 2, 1976

[54] FOUNTAIN PEN

[76] Inventor: Otto Mutschler,
Ludolf-Krehl-Strasse 21, D-69
Heidelberg, Germany

[22] Filed: Mar. 11, 1975

[21] Appl. No.: 557,362

[30] Foreign Application Priority Data

Mar. 27, 1974 Germany ..... 2414678

[52] U.S. Cl. ..... 401/243; 401/213

[51] Int. Cl. ..... B43k 9/00

[58] Field of Search ..... 401/243–246, 401/213, 202, 198, 199, 117, 124

[56] References Cited

UNITED STATES PATENTS 3,171,196 3/1965 Helitas ..... 401/244 X

FOREIGN PATENTS OR APPLICATIONS 782,159 9/1957 United Kingdom ..... 401/213

1,032,583 6/1966 United Kingdom ..... 401/243

*Primary Examiner*—Lawrence Charles
*Attorney, Agent, or Firm*—Hans Berman

[57] ABSTRACT

The cap of a fountain pen is releasably locked to the barrel by spherically arcuate projections in the bore of the cap engaging a groove in the barrel which is bounded by a circumferential sealing rib on the barrel in a direction inward of the cap when the latter is in the closed position. Three, equiangularly distributed, axial ribs in the cap guide the barrel during insertion of the barrel into the cap and bound capillary ducts in the assembled pen which collect condensate from the air chamber surrounding the nib and prevent contamination of the condensate with coloring matter from the ink. The sealing rib on the barrel engages a cylindrical face portion of the cap between the projections and the outer ends of the guide ribs.

10 Claims, 3 Drawing Figures

FOUNTAIN PEN

Figure 1:
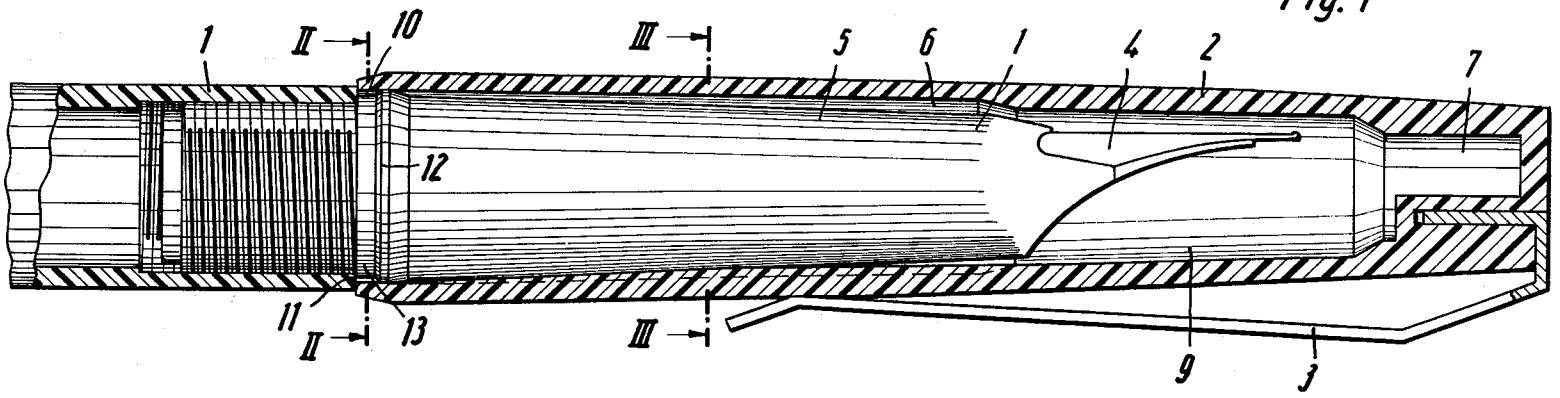

This invention relates to writing implements, and particularly to a fountain pen.

In its more specific aspects, this invention is concerned with an improvement in writing implements, such as fountain pens, in which a writing tool projects from one axially terminal portion of an ink-containing, elongated barrel and may be covered by a cap whose bore is dimensioned for relative coaxial, translatory movement of the cap and barrel toward and away from a closed position in which the writing tool is received in the bore.

Fountain pens in which the cap is not threadedly mounted on the barrel are difficult to seal hermetically so that ink in the barrel, which communicates with the nib, may not dry out during extended idle periods. To be effective, the successful pens of this type rely on resilient sealing elements remote from the open end of the cap and close to the nib in the closed pen. During closing of the pen, ink is likely to be transferred to the sealing element from the nib, and thereafter to the axial barrel wall by the engaged sealing element. If water evaporates from the ink in the closed end of the cap under suitable conditions of external temperature, it dissolves dried residual ink from the sealing element and the colored liquid collects on the barrel wall to soil the fingers of the user during subsequent use.

It is an important object of the invention to provide a writing implement of the type described in which colored liquid cannot reach the portion of the barrel gripped by the user's fingers during writing unless there is a major leakage of ink in the closed pen.

Another object is the provision of a fountain pen in which the cap is hermetically sealed to the barrel in the closed condition, the same elements of the pen providing the locking and sealing function so that the structure of the pen is simple.

With these and other objects in view, the writing implement of the invention has a writing tool projecting from one axially terminal portion of an elongated barrel, the barrel being formed with a cavity normally containing ink. The cap of the implement has an axial bore open in one axial direction and closed in the other axial direction which is dimensioned for relative, coaxial, translatory movement of the cap and barrel toward and away from a closed position in which the writing tool is received in the cap bore. In that position, an air chamber separates the tool from the cap in all directions other than toward the open bore end.

The barrel is guided into the closed position by three circumferentially spaced, axially elongated guide ribs which project from the cap into the bore and radially engage the barrel in the closed pen position. An annular sealing rib radially projects from the barrel which is formed with a circumferential, annular groove offset from the sealing rib in an axial direction away from the writing tool. The sealing rib sealingly engages an annular face portion of the cap between the outer ends of the guide ribs and several radial projections which lockingly engage the annular barrel groove in the closed pen.

Figure 3:
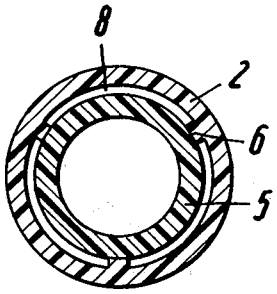
Figure 2:
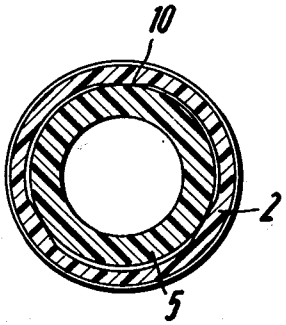

Other features, additional objects, and many of the attendant advantages of this invention will readily be appreciated as the same becomes better understood by reference to the following detailed description of a preferred embodiment when considered in connection with the appended drawing in which:

FIG. 1 shows a fountain pen of the invention in fragmentary side-elevational sections; and FIGS. 2 and 3 illustrate the pen of FIG. 1 in rear elevational section on the lines II—II and III—III respectively.

In the closed position illustrated, the pen of the invention is of conventional appearance, presenting to the viewer the reservoir portion 1 of a barrel whose sealed cavity is adapted to contain ink, a cap 2, and a clip 3, the clip having been omitted from FIGS. 2 and 3. The barrel and cap are of generally circular cross section about a common longitudinal axis and consist of molded synthetic resin composition or plastic. The clip 3 is of metal as is the pen nib 4 which projects from a tubular plastic carrier portion 5 of the barrel in the cap 2, the carrier portion being threadedly mounted in the reservoir portion 2. The structure described so far is conventional.

As is better seen in FIG. 3, three integrally molded, axial guide ribs 6 project from the inner axial wall of the cap 2 in equiangularly spaced relationship. The ribs 6 extend over most of the axial length of the carrier portion 5 to a point near the open end of the bore 7 in the cap 2 and taper in this direction. In the closed pen, the inner wall surface of the cap 2, the outer wall surface of the barrel portion 5 and the three guide ribs 6 seal three ducts 8 in all directions transverse to the pen axis. Each duct 8 is circumferentially wider than the combined circumferential width of the three guide ribs 6, and the radial height of each duct is but a small fraction of its circumferential width even where the ducts 8 are highest near the nib 4. The ducts 8 are axially open toward an air chamber 9 bounded, in the illustrated closed position of the pen, by the cap 2 and the nib 4 and separating the nib from the closed end of the cap and from the inner axial wall of the cap. The ducts 8 communicate with the air chamber 9.

The ribs 6 merge with the approximately cylindrical inner face of the cap 2 a short distance from the open end of the cap 2, and are separated by an axially narrow, annular portion of the inner cap face from three projections 10 arranged in a common radial plane contiguously adjacent the open end of the bore 7. The projections 10, best seen in FIG. 2, are of spherically arcuate shape and merge with the inner cap face at a small acute angle.

The nib carrier portion 5 of the barrel is smaller in diameter than the reservoir portion so that the assembled barrel has a shoulder 11 whose annular radial face abuttingly engages the annular radial end face of the cap 2 about the open end of the bore 7 in the closed position of the pen.

An integral, circumferential, sealing rib 12 projects radially outward from the nib carrier portion 5 spacedly adjacent the shoulder 11. Its two conical flanks taper toward the open and closed ends of the cap 2 respectively in the illustrated closed position of the pen, and merge in an angular ridge. The rib 12 and the shoulder 11 thus axially define a circumferential, annular groove 13 in the barrel 1, 5 whose bottom is formed by a cylindrical face of the nib carrier portion 5, and whose axial width is approximately equal to the corresponding dimension of the projections 10, axial clearance, if any, being much smaller than the axial width of the sealing rib 12.

The thermoplastic material of the cap 2 and of the barrel 1, 5 is slightly resilient. When the cap 2 is placed on the barrel 1, 5, the nib carrier portion 5 and the nib 4 are guided into the bore 7 by the ribs 6 which hold the nib 4 out of contact with the inner face of the cap 2. Toward the end of the closing stroke, the sealing rib 12 enters the bore 7 of the cap.

In the relaxed condition, the projections 10 define an orifice of the bore 7 which is smaller in available diameter than the ridge of the sealing rib 12. The resiliency of the cap 2 and of the rib 12 is sufficient to permit the projections 10 to slide over the rib 12, and to drop into the groove 13 when the radial end face of the cap 2 abuts against the shoulder 11. The annular, inner face portion of the cap 2 axially separating the ribs 6 from the projections 10 has the same or a slightly smaller diameter than the ridge of the sealing rib 12, so that the ridge engages the face portion over the entire inner circumference of the cap 2, the narrow ridge of the sealing rib yielding to compensate for unavoidable minute manufacturing tolerances.

As is conventional, the cavity of the reservoir portion 1 normally contains a body of liquid ink, not shown, and the nib carrier portion 5 is shaped in a non-illustrated manner to connect the reservoir portion with the nib 4 so that ink may be dispensed from the nib in a controlled manner. Because the nib is held out of contact with the inner face of the cap 2 by the ribs 6 while entering the bore 7, any residual ink on the nib 4 cannot be transferred from the nib to the inner cap face and thence to the barrel portion 5 to soil the fingers of the user during subsequent use.

The air chamber 9 in the closed pen is hermetically sealed from the ambient atmosphere by the sealing rib 12, some sealing effect also being provided by the abuttingly engaged annular faces of the shoulder 11 and the cap 2 due to the camming interaction of the projections 10 with the outwardly directed flank of the sealing rib 12. As is evident from FIG. 1, that flank is steeper than the flank directed toward the closed end of the cap 2, whereby the force required to unlock the cap 2 is greater than that which will push the projections 10 over the rib 12 to lock the cap 2 in the closed position.

Under unfavorable temperature conditions, water may evaporate from the ink in the barrel and nib and condense on the inner face of the cap 2. The condensate cannot mix with ink on the nib 4 and is drawn by capillary action into the ducts 8. If the amount of condensate is small, as is usual, it is contained in the narrowest parts of the ducts 8 nearest the sealing rib 12. When the nib 4 is moved out of the cap 2 prior to use of the pen, the thin ring sections of condensate on the inner wall of the cap 2 are not touched by the nib 4, and the barrel is not contaminated with coloring matter. Condensate on the barrel may evaporate completely before being touched by the user's hand.

While the invention has been described with reference to ink wetting the inner wall faces of the reservoir portion 1, the invention is equally useful for fountain pens employing ink cartridges. The shape and function of the nib 4 is not directly relevant to this invention, and its full advantages are available in drafting pens employing a thin tubular rod as a writing tool. In an analogous ball pen, the smooth guided entry of the barrel into the cap of the invention and the easy locking and unlocking of the cap are convenient to the user though few of the afore-discussed problems associated with liquid writing ink are important in a ball pen.

The three plastic elements 1, 2, 5 of the illustrated pen are preferably made by injection molding of suitable thermoplastic material, but the reservoir portion 1 may be made of metal at low cost. It is more difficult to shape the nib carrier portion 5 and the cap 2 with the necessary precision and the desired low weight from presently available materials other than thermoplastic synthetic resin composition.

Three guide ribs 6 are necessary for properly centering the nib 4 in the cap 2, but more may be provided although they do not offer significant advantages and reduce the available capacity of the ducts 8. Similarly, the number of the spherically arcuate projections 10 may be increased beyond the three specifically shown. If more projections are provided, they should be angularly interposed between the guide ribs 6 in the manner evident from joint consideration of FIGS. 2 and 3 to make best use of the resilient properties of the sealing rib 12. The greatest possible radial width of the air chamber 9 surrounding the nib 4 should be maintained, and it is preferred for this reason axially to offset the inner ends of the ribs 6 from the nib 4. However, an adequate spacing between the nib and longer guide ribs 6 may be maintained by limiting the angular positions that the barrel may assume in the bore 7.

It should be understood, therefore, that the foregoing disclosure relates only to a preferred embodiment of the invention, and that it is intended to cover all changes and modifications of the examples of the invention herein chosen for the purpose of the disclosure which do not constitute departures from the spirit and scope of the invention set forth in the appended claims.

What is claimed is:

1. A writing implement comprising:

a. an elongated barrel having a longitudinal axis and formed with a cavity adapted to contain ink;

b. a writing tool projecting from one axially terminal portion of said barrel and communicating with said cavity for dispensing said ink;

c. an elongated cap having a longitudinal axis and formed with an axial bore open in one axial direction and closed in the other axial direction, 1. said bore being dimensioned for relative coaxial translatory movement of said cap and of said barrel toward and away from a closed position in which said writing tool is received in said bore, 2. said writing tool and said cap in said position bounding an air chamber separating said tool in said bore from said cap in said other axial direction and in all radial directions;

d. three circumferentially spaced, axially elongated guide ribs projecting from said cap in said bore and radially engaging said barrel in said closed position;

e. a plurality of circumferentially spaced radial projections on said cap in said bore adjacent the axially open end of said bore; and f. an annular sealing rib projecting from said barrel in a radial plane, the barrel being formed with a circumferential annular groove offset from said sealing rib in an axial direction away from said writing tool, 1. said projections and said guide ribs axially bounding therebetween an annular face portion of said cap in said bore, said face portion being of circular cross section, 2. said sealing rib sealingly engaging said face portion in said closed position.

2. An implement as set forth in claim 1, wherein said guide ribs and respective opposite axial faces of said cap and of said barrel in said bore define three axially elongated ducts communicating with said air chamber and sealed by said sealing rib in said other axial direction in the closed position of said implement.

3. An implement as set forth in claim 2, wherein the combined circumferential width of said guide ribs is smaller than the circumferential width of each of said ducts.

4. An implement as set forth in claim 3, wherein the radial height of each of said ducts is smaller than the circumferential width thereof and decreases in said one axial direction.

5. An implement as set forth in claim 1, wherein said barrel has an annular radial face, and said cap has an annular radial face about the open end of said bore, said radial annular faces being contiguously adjacent each other in said closed position.

6. An implement as set forth in claim 5, wherein said annular radial face of said barrel and said sealing rib axially bound said circumferential groove, said groove being dimensioned to receive said radial projections in said closed position with an axial clearance smaller than the axial width of said sealing rib.

7. An implement as set forth in claim 6, wherein said sealing rib has two axially juxtaposed, annular faces tapering conically in said one axial direction and said other axial direction respectively.

8. An implement as set forth in claim 1, wherein said cap, said guide ribs, and said radial projections jointly constitute a unitary body of synthetic resin composition sufficiently resilient to permit axial movement of said sealing rib into a position of sealing engagement with said annular face portion.

9. An implement as set forth in claim 1, wherein said tool is axially spaced from said guide ribs in said other axial direction.

10. An implement as set forth in claim 1, wherein each of said projections is angularly offset from each of said guide ribs.

* * * * *